US010443994B2

(12) United States Patent
Gatti

(10) Patent No.: US 10,443,994 B2
(45) Date of Patent: Oct. 15, 2019

(54) LOADING MACHINE FOR CARTRIDGES WITH A METAL CASE

(71) Applicant: E.M.G. SRL, Pozzaglio Ed Uniti (CR) (IT)

(72) Inventor: Giorgio Gatti, Cremona (IT)

(73) Assignee: E.M.G. SRL, Pozzaglio Ed Uniti (CR) (IT)

( * ) Notice: Subject to any disclaimer, the term of this patent is extended or adjusted under 35 U.S.C. 154(b) by 12 days.

(21) Appl. No.: 15/776,740

(22) PCT Filed: Nov. 18, 2016

(86) PCT No.: PCT/IT2016/000273
§ 371 (c)(1),
(2) Date: May 16, 2018

(87) PCT Pub. No.: WO2017/085751
PCT Pub. Date: May 26, 2017

(65) Prior Publication Data

US 2018/0335286 A1 Nov. 22, 2018

(30) Foreign Application Priority Data

Nov. 19, 2015 (IT) ..... 102015000074220

(51) Int. Cl.
*F42B 33/00* (2006.01)

(52) U.S. Cl.
CPC ..... *F42B 33/002* (2013.01); *F42B 33/001* (2013.01)

(58) Field of Classification Search
CPC .... F42B 33/004; F42B 33/02; F42B 33/0207; F42B 33/001; F42B 33/0285;
(Continued)

(56) References Cited

U.S. PATENT DOCUMENTS 454,578 A * 6/1891 Jacobs ..... F42B 33/004 86/27
2,350,181 A * 5/1944 Morgan ..... F42B 33/002 86/31

(Continued)

FOREIGN PATENT DOCUMENTS

EP 2 827 092 A1 1/2015

OTHER PUBLICATIONS

International Search Report and Written Opinion, dated Mar. 6, 2018, from corresponding PCT application No. PCT/IT2016/000273.

*Primary Examiner* — Joshua E Freeman
*Assistant Examiner* — Bridget A Cochran
(74) *Attorney, Agent, or Firm* — Young & Thompson

(57) ABSTRACT

Disclosed is a loading machine for cartridges with a metal case including a frame structure; a feed unit for a plurality of cases having a longitudinally extending axis; a first operating beam having an alternating vertical translation movement, provided with working tools having a vertical axis, adapted to load the cases; feed and a conveyor of the cases and element for ejecting the loaded cartridges; a motor and a control unit. The feed unit includes a race and a conveyor guide comb defining a plurality of seats, containing the cases conveying them along the race. The conveyor guide includes bushings, each including at least a first conical surface and a hole to house one of the bushings and being housed in one of the seats. The machine includes a second operating beam, having an alternating vertical translation movement, provided with a plurality of hollow centering cylinders having a vertical axis.

6 Claims, 7 Drawing Sheets

(58) Field of Classification Search
CPC ..... F42B 33/0214; F42B 33/10; F42B 33/00; F42B 33/025; F42B 5/181; F42B 1/036; F42B 33/0235; F42B 39/002; F42B 5/16; F42B 5/188; F42B 8/04
See application file for complete search history.

(56) References Cited

U.S. PATENT DOCUMENTS 2,371,126 A * 3/1945 Best et al. ..... B65G 47/1457 221/182
2,376,293 A * 5/1945 Vergobbi ..... F42B 33/002 198/455
2,818,964 A * 1/1958 Picard ..... F42B 33/002 112/108
3,153,976 A * 10/1964 Linder ..... F42B 33/004 86/26
3,450,000 A * 6/1969 Ponsness ..... F42B 33/004 86/25
3,580,127 A * 5/1971 Lee ..... F42B 33/005 86/24
3,602,084 A * 8/1971 Corcoran ..... F42B 33/001 86/23
3,610,090 A * 10/1971 Corcoran ..... F42B 33/10 86/23
3,732,774 A * 5/1973 Griffin ..... F42B 33/004 86/23
3,771,411 A * 11/1973 Hazel ..... F42B 33/004 86/24
3,788,035 A * 1/1974 Geisel ..... F42B 33/002 53/282
3,796,127 A * 3/1974 Deitemeyer ..... F42B 33/004 86/25
3,857,319 A * 12/1974 Welch ..... F42B 33/004 86/23
3,916,758 A * 11/1975 Ashbrook ..... F42B 33/002 279/46.7
4,020,737 A * 5/1977 Ransom ..... F42B 33/004 86/23
4,078,472 A * 3/1978 Simpson ..... F42B 33/10 86/23
4,292,877 A * 10/1981 Lee ..... F42B 33/0292 86/23
4,312,438 A * 1/1982 Vatsvog ..... B65G 47/1457 198/392
4,328,735 A * 5/1982 Allen ..... F42B 33/04 86/23
4,331,063 A * 5/1982 Schaenzer ..... F42B 33/004 86/23
4,425,833 A * 1/1984 Purdie ..... F42B 33/002 86/26
4,475,435 A * 10/1984 Mantel ..... F42B 33/002 86/25
4,522,102 A * 6/1985 Pickens ..... F42B 33/004 86/23
4,573,392 A * 3/1986 Mantel ..... F42B 33/002 86/43
4,677,894 A * 7/1987 Pongratz ..... F42B 39/22 73/167
4,852,451 A * 8/1989 Rogers ..... F42B 33/0285 86/33
5,024,135 A * 6/1991 Bender ..... F42B 33/004 86/27
5,133,240 A * 7/1992 Thiesen ..... F42B 5/181 102/431
5,177,315 A * 1/1993 Burgess ..... F42B 33/004 86/23
5,179,243 A * 1/1993 Schroeder ..... F42B 33/002 86/25
5,335,578 A * 8/1994 Lorden ..... F42B 33/002 86/25
5,507,132 A * 4/1996 Gwiazdon ..... B65B 43/52 53/284.7
5,719,348 A * 2/1998 Bill ..... F42B 33/00 206/3
5,763,810 A * 6/1998 Lee ..... F42B 33/002 86/23
5,900,574 A * 5/1999 Hart ..... F42B 33/004 86/23
6,041,687 A * 3/2000 Fowler ..... F42B 33/002 86/23
6,739,111 B2 * 5/2004 Banks ..... B65B 3/12 141/18
7,134,255 B2 * 11/2006 Monti ..... B65B 3/16 53/53
7,552,668 B1 * 6/2009 Gonzalez ..... F42B 33/00 86/45
7,694,618 B1 * 4/2010 Lee ..... F42B 33/001 86/32
8,276,494 B2 * 10/2012 Palkowitsh ..... F42B 33/001 86/45
9,151,583 B1 * 10/2015 Stark ..... F42B 33/004
9,360,284 B1 * 6/2016 Moore ..... F42B 33/00
9,846,018 B1 * 12/2017 Schloer ..... F42B 33/002
2002/0121184 A1 * 9/2002 Fowler ..... F42B 33/002 86/45
2004/0025678 A1 * 2/2004 Shields ..... F42B 33/02 86/31
2006/0182611 A1 * 8/2006 Gatti ..... B65B 5/101 414/788.1
2008/0053296 A1 * 3/2008 Koskela ..... F42B 33/10 86/24
2010/0122624 A1 * 5/2010 Jackson ..... F42B 33/001 86/23
2013/0139675 A1 * 6/2013 Baxter ..... F42B 33/001 86/31
2013/0152771 A1 * 6/2013 Coma Asensio .. B65G 47/1457 86/19.5
2014/0260925 A1 * 9/2014 Beach ..... F42B 33/001 86/28

* cited by examiner

LOADING MACHINE FOR CARTRIDGES WITH A METAL CASE

The present invention relates to the sector of lines for the production and loading of cartridges, and in particular relates to a loading machine for cartridges with a metal case, equipped to receive the empty cases provided with a primer, and to prepare them and provide them with the components needed to produce cartridges that are ready for use.

BACKGROUND OF THE INVENTION

According to known art, loading machines for cartridges with a metal case substantially comprise a frame structure, feed means for metal cases, for ogival balls and for gunpowder, an operating beam supporting accessory means for in-line loading and processing of said cartridges, feed and conveying means of the cartridges during loading, and means for ejecting the loaded cartridges.

According to known art, the cartridge feed and conveying means generally comprise a race on which are the metal cases are positioned and slid, resting on their base with their open end pointing upwards, wherein the accessory loading means, or working tools, perform checking operations and introduce in sequence the various components that will go to make up and complete the finished cartridge.

Said cartridge feed and conveying means further comprise a conveyor guide, comb shaped and arranged parallel to said race, along its side turned towards the front of the machine and the operator, adapted to convey said cartridges along said race, to position them, according to the various filling steps, under the respective accessory loading means.

The main drawbacks of these loading machines for cartridges with metal cases concern the difficulty in keeping the cartridges perfectly coaxial with the respective filling means, during the various conveying and loading steps.

A non-perfect alignment between the axis of the cartridge, particularly of the metal case, and the vertical downward axis of the working tool risks ruining and damaging the case itself during filling, for example there may occur a lateral deformation of the case or its mouth may be crushed.

Similarly, there may disadvantageously be a deformation of the ball during its positioning on the case, or its positioning may be inclined with respect to the axis of the case, which could compromise the trajectory of the bullet when fired.

Further drawbacks relate to the long machine preparation times due to possible changes in the caliber of the cartridges being produced.

A single machine may in fact be used to produce cartridges of different calibers, and therefore, when passing from one caliber to another, the dimensions of the case race need to be varied with extreme precision, so as to keep the axis of the cartridge unchanged with respect to the working devices associated with the frame and to allow the correct operation of the machine and kinematic coordination of all moving parts.

In the traditional machine described above, in order to switch from the production of cartridges of a certain caliber to cartridges of another caliber, the operator has to manually perform the following operations:

- moving the conveyor guide back, with respect to the cartridge race, by loosening the respective fixing means;
- distributing the new-caliber cases along the race;
- re-positioning the conveyor guide using measurement and alignment instruments adapted to ensure perfect parallelism and the correct distance between the race and the guide, in addition to trying to restore a condition of substantial coaxiality between the cartridge case and the working tools above;
- stably fixing the guide to the moving parts, by re-positioning and tightening the respective fixing means.

Disadvantageously, all these operations require a great deal of time, forcing the machine to be out of service for long periods, with consequent slow-down and reduction in productivity, causing economic losses.

Operators also need to use different instruments for measuring and checking the alignment and respect for the correct distance between the machine components, with obvious complications in terms of tuning and registry before the re-start of work.

SUMMARY OF THE INVENTION

The present invention suggests to overcome these limits, by providing a loading machine that can automatically ensure, at each loading station, perfect coaxiality between the case and working tools adapted to load and work on it, so as to protect all components of the cartridge, starting with the metal case itself, against possible deformations that could subsequently compromise the efficiency thereof.

A further object of the invention is to provide an efficient, productive loading machine, provided with cartridge feed and conveying means that allow the machine to be quickly and easily prepared for operation when changing the caliber of the cartridges to be produced.

These objects are achieved by a loading machine for cartridges with a metal case comprising:

- a frame structure;
- feed means for a plurality of cases having a given caliber and a longitudinally extending axis;
- feed means for a plurality of ogival balls adapted to act as bullets;
- feed means for gunpowder;
- a first operating beam having an alternating vertical translation movement, provided with working tools having a vertical axis, adapted to load said cases;
- feed and conveying means of said cases during loading;
- means for ejecting the loaded cartridges;
- motor means for activation of kinematic mechanisms;
- a control unit;

wherein said feed means of said cases comprise:

- a race adapted to support and to allow feed of said cases in a given direction;
- a conveyor guide, arranged parallel to said race and comb shaped to define a plurality of seats, adapted to contain said cases and to convey them along said race, to position them, according to the various filling steps, under respective working tools, characterized in that:

- said conveyor guide comprises a plurality of bushings, each bushing comprising at least a first conical surface and a hole adapted to house one of said cases and being housed in one of said seats, wherein the outer diameter of said bushing is less than the inner dimension of said seats so as to have a minimum freedom of movement between bushing and respective seat;
- said machine comprises a second operating beam, having an alternating vertical translation movement coordinated with the alternating vertical translation movement of said first operating beam, wherein said second operating beam is provided with a plurality of hollow centering cylinders, having a vertical axis and a second conical surface inside them, each centering cylinder being arranged so that its vertical axis coincides with the vertical axis of one of said tools, wherein coupling between the first conical surface of each bushing and the second conical surface of a corresponding centering cylinder causes shifting of said bushing in said seat, and consequently shifting of the case housed in said bushing, to obtain coaxiality between the longitudinal axis of said case and the vertical axis of said centering cylinder.

Advantageously, said bushings comprise at least one radial cut, adapted to allow their elastic deformation when inserting the case into the hole.

According to a second aspect of the invention, said conveyor comprises means for reversibly retaining said bushings in said seats, to allow them to be removed and replaced as a function of the caliber of the cases to be loaded.

In a preferred embodiment of the invention, each seat is U-shaped and said retaining means comprise pins, the head of which at least partially engages the space comprised between the arms of each U-shaped seat.

In particular, said bushing comprises an annular groove obtained on its outer surface, and the arms of said U-shaped seat are adapted to engage said groove to sustain said bushing.

According to a further aspect of the invention, said frame structure comprises vertical guides engaged simultaneously by said first and said second operating beam, so that the planes to which said beams belong remain perfectly parallel to each other during the translation movement.

The advantages of the invention are multiple and are illustrated below.

The free space between each bushing and its corresponding seat provides a sort of "clearance" that allows the centering cylinder, once it has descended to embrace the bushing, to move it, even by a minimal amount, but enough to compensate for any misalignments between the axis of the case and the axis of the working tool.

Cooperation between the first conical surface of each bushing and the second conical surface of the corresponding centering cylinder guarantees coupling stability and results in the shifting of the bushing so as to ensure perfect axiality between the case axis and the axis of the corresponding working tool operating above it.

In the case of a working tool adapted to insert the ball into the case, perfect axiality between the components is essential when positioning the ball, so as to ensure precision in bullet trajectory.

Also during the phase of preparing the case before loading it with gunpowder, it is essential to have coaxiality between the working tool and the case itself, so as to avoid deformations thereto, which would otherwise be rejected at a later stage of the production line.

The alignment precision achieved between case and working tool is such as to be able to advantageously avoid the traditional flaring of the case mouth before insertion of the ball, with consequent advantages in terms of processing times and simplification of machine operating steps.

The radial cuts made on each bushing allow for its elastic deformation, and therefore for its adaptation to cases with caliber dimensions other than those normally envisaged by case production tolerances.

The pressing action of the centering cylinder on the bushing results in an elastic deformation thereof, adapted to hold the case in the bushing and, vice-versa, to release it once it is loaded.

A further advantage consists in the speed with which it is possible to prepare the machine each time the caliber of the cartridge to be processed is changed.

The means for reversibly retaining the conveyor guide bushings allow the easy replacement of the bushings, which can therefore be selectively chosen according to the diameter of their internal hole, corresponding to the caliber of the cases that it has to hold.

By optimizing the machine preparation times, which are drastically reduced, production is significantly increased, with a consequent economic benefit.

Said first and second operating beam, although having a coordinated vertical translation movement, which can also be advantageously obtained by means of independent kinematic means, engage the same vertical guides for their movement, thereby ensuring the set coaxiality of the centering cylinders with the working tools and perfect perpendicularity between the respective axes and the main machine plane defined by the race on which the cases are standing.

The advantages of the invention will be more apparent below, in the description of a preferred embodiment, provided by way of non-limiting example, and with the aid of the drawings, wherein:

DETAILED DESCRIPTION OF THE PREFERRED EMBODIMENTS

Figure 1:
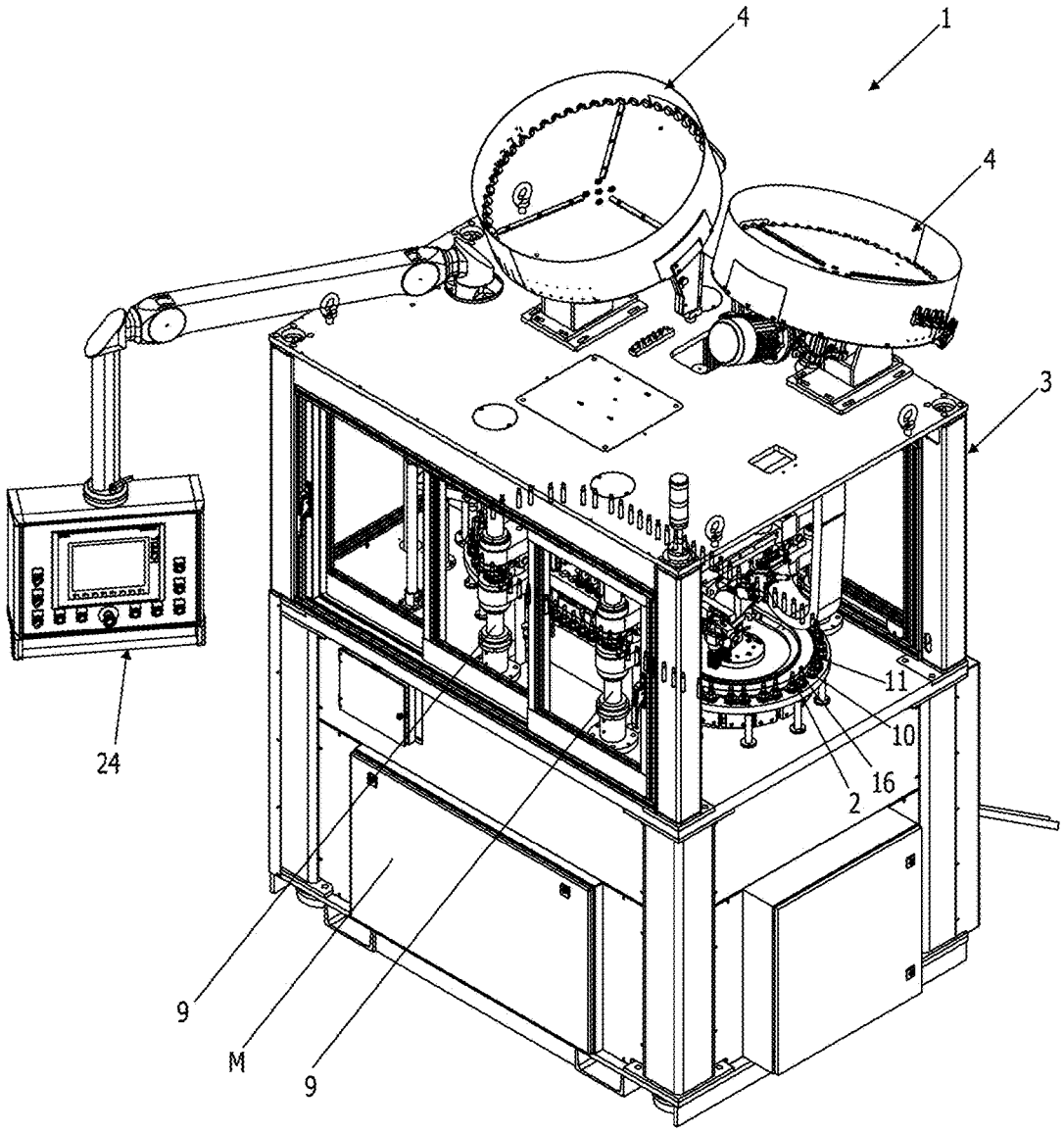
FIG. 1 shows an axonometric view of a loading machine for cartridges with a metal case according to the invention.
Figure 2:
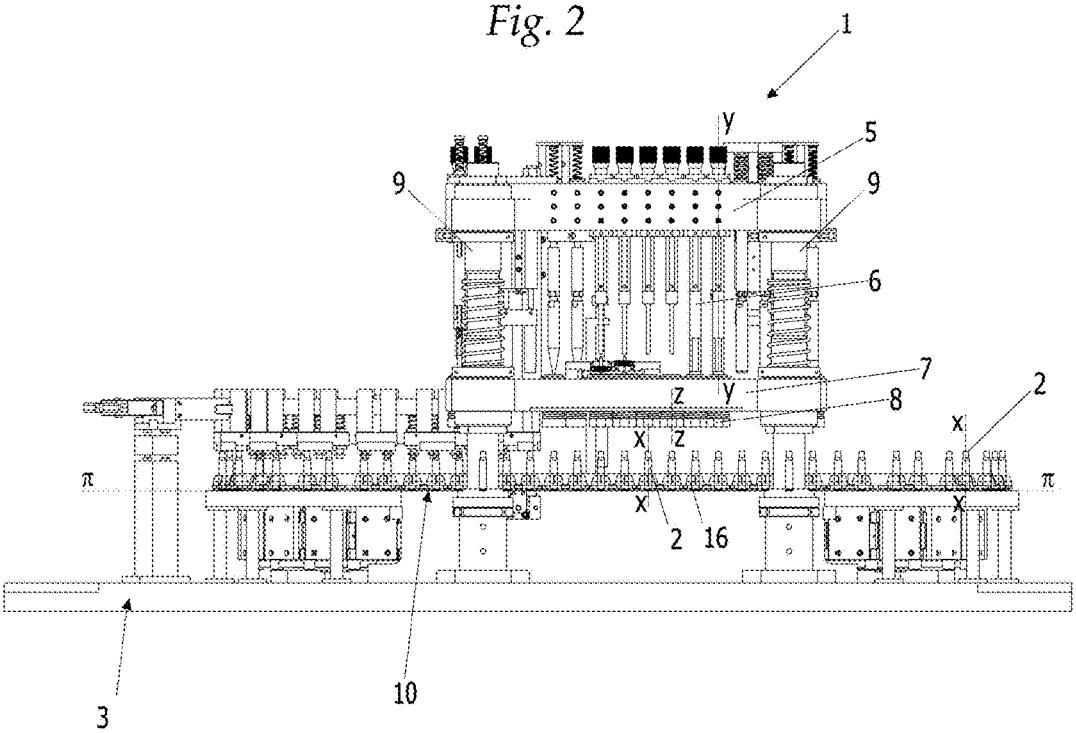
FIGS. 2 and 3 show, in transversal cross-section along a vertical plane, a part of the machine illustrated in FIG. 1, in two different working stages.
Figure 3:
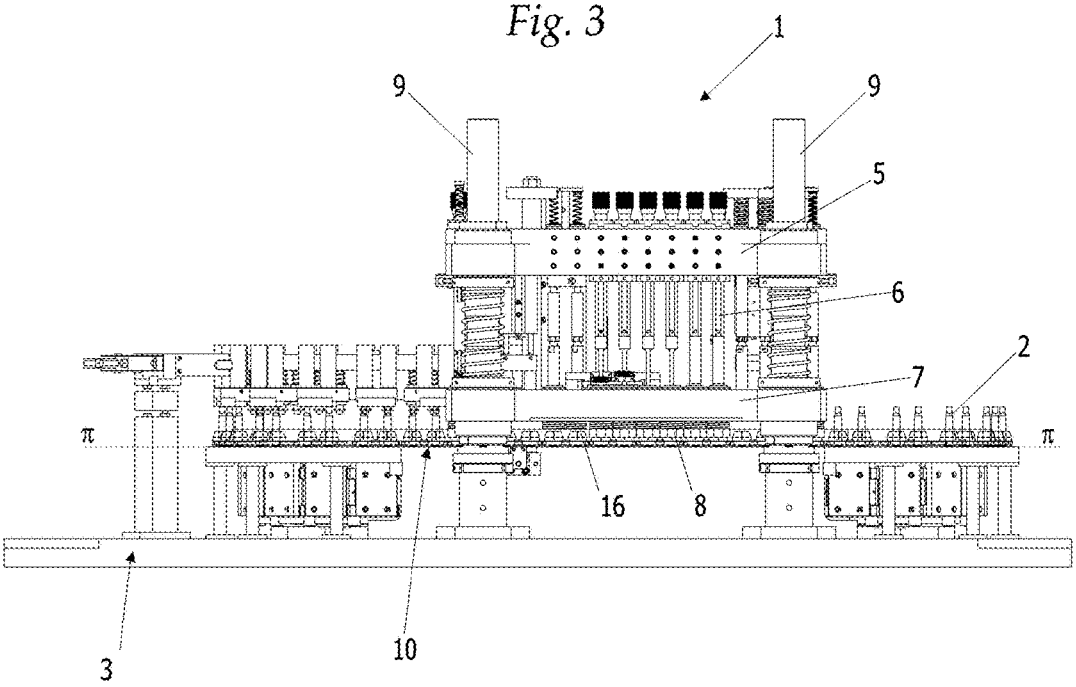

With reference to FIGS. 1-3, there is illustrated a loading machine 1 for cartridges with a metal case 2, adapted for the preparation and production of ammunition with a single ogival ball used in the sporting and military sector.

Said machine 1 essentially comprises:

- a frame structure 3 on which are provided feed means 4 for a plurality of cases 2 having a given caliber c and a longitudinally extending axis x, and feed means for a plurality of ogival balls and for gunpowder;
- a first operating beam 5 having an alternating vertical translation movement, provided with working tools 6 having a vertical axis y, adapted to load and process said cases 2;
- feed and conveying means of said cases 2 during loading;
- means for ejecting the loaded cartridges;
- motor means M for activation of kinematic mechanisms;
- a control unit 24 adapted to supervise all functions of the machine 1.

Said machine 1 further comprises a second operating beam 7, also having an alternating vertical translation movement, coordinated with the alternating vertical translation movement of said first operating beam 5.

Said second operating beam 7 is provided with a plurality of hollow centering cylinders 8, having a vertical axis z.

Each centering cylinder 8 is arranged along said second operating beam 7 so that its vertical axis z coincides with the vertical axis y of one of said filling tools 6 provided on said first operating beam 5.

Henceforth in the text, said first operating beam 5 is referred to as the striking beam, while said second operating beam 7 is referred to as the pushing beam, in relation to the work that each beam, and the respective accessory means 6, 8, perform on the cases 2 and on the case feed means.

Said frame structure 3 comprises vertical guides 9 engaged simultaneously by said first 5 and said second 7 operating beam, so that the planes to which said beams 5, 7 belong remain parallel to each other during the translation movement, to ensure stable coaxiality between the vertical axis z of each centering cylinder 8 and the vertical axis y of the corresponding working tool 6.

In the machine 1 subject of the invention, said feed means of said cases 2 extend along an elliptical trajectory and comprise:

- a race 10 adapted to support and to allow feed of said cases 2 in a given direction on a reference plane π made perfectly horizontal and perpendicular to the vertical guides 9, so as to also guarantee perfect perpendicularity between the axes y and z and the reference plane itself;
- a conveyor guide 11, arranged parallel to said race 10, comb shaped to house each case 2 during its movement.

In detail, said conveyor guide 11 comprises a plurality of U-shaped seats 12.

Figure 5:
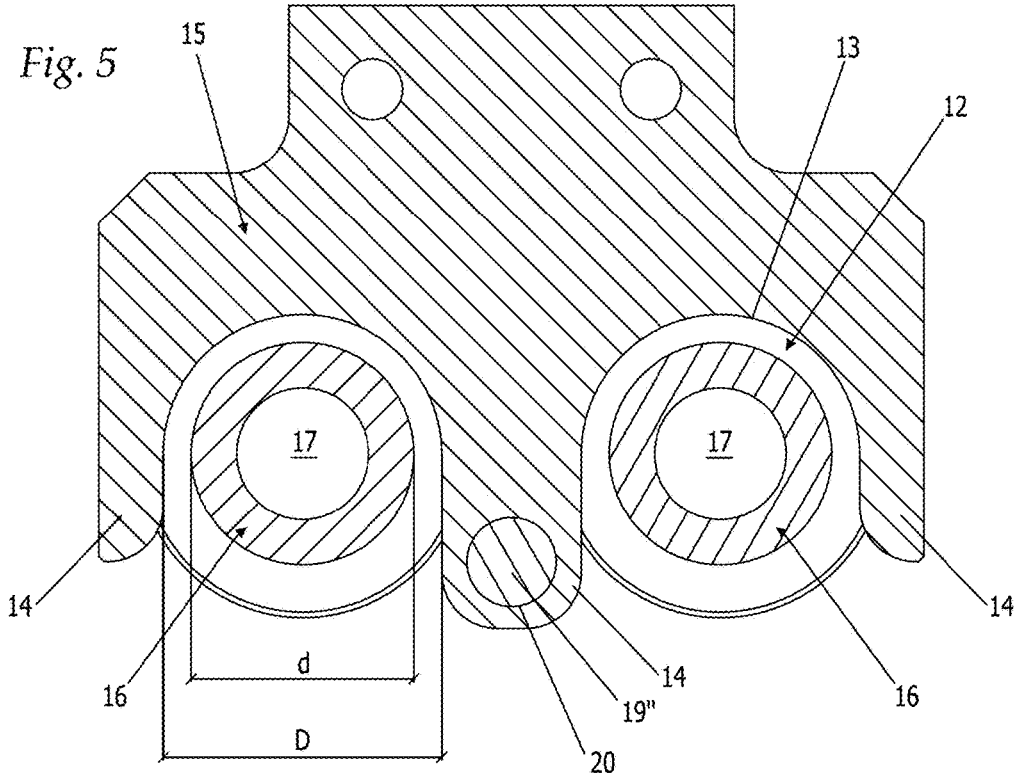

With particular reference to the transversal cross-section shown in FIG. 5, each seat 12 comprises a curved central portion 13 and two side arms 14 parallel to one another. The distance D between the two arms 14 defines the inner dimension of the seat 12.

In the variant illustrated, said comb-shaped conveyor guide 11 is obtained by means of a plurality of forks 15 arranged in sequence and connected to a feed kinematic chain that follows the elliptical trajectory of the race 10.

Each fork 15 therefore delimits two seats 12, where said two adjacent seats 12 have one arm 14 of the U in common.

Said conveyor guide 11 also comprises a plurality of bushings 16 adapted to support said cases 2 and to move them along said race 10, to position them, depending on the various filling steps, under respective working tools 6.

FIGS. 4-7 show the bushings 16 in detail.

Each bushing 16 comprises a central hole 17 adapted to host one of said cases 2.

This hole 17 has a diameter φ that is compatible, with the tolerances required, with the caliber c of the case 2 that it has to host.

The loading machine is adapted to be equipped with bushings 16 provided with holes 17 with adequate diameters φ to be able to adapt to the possible calibers c of the cases 2 being processed.

Each bushing 16 also comprises an annular groove 18, obtained on its outer surface, adapted to be engaged by the arms 14 of one of said seats 12.

So as to have a minimum freedom of movement of each bushing 16 in its respective seat 12, the outer diameter d of said bushings 16, measured at their annular groove 18, is smaller than the inner dimension D of said seats 12.

Figure 4:
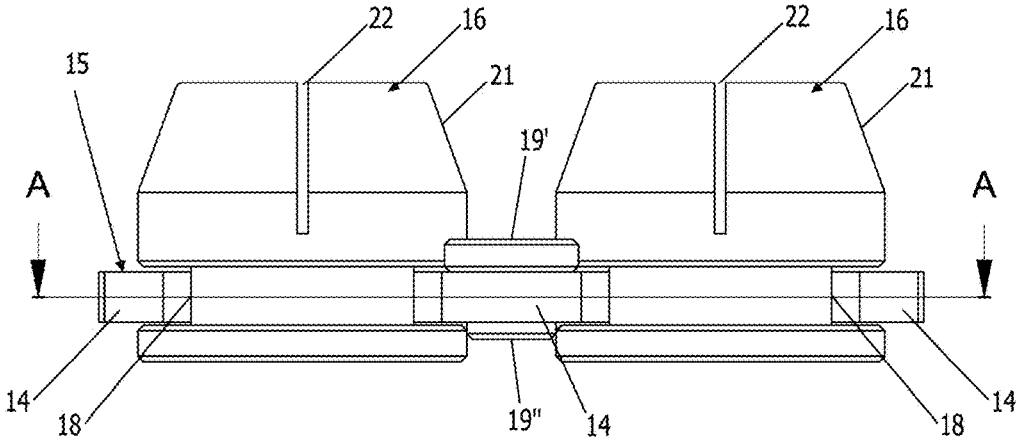
FIGS. 4-6 show, respectively, a side view, in transversal cross-section along a horizontal plane, and an axonometric view, of a detail of the machine according to the invention.
Figure 6:
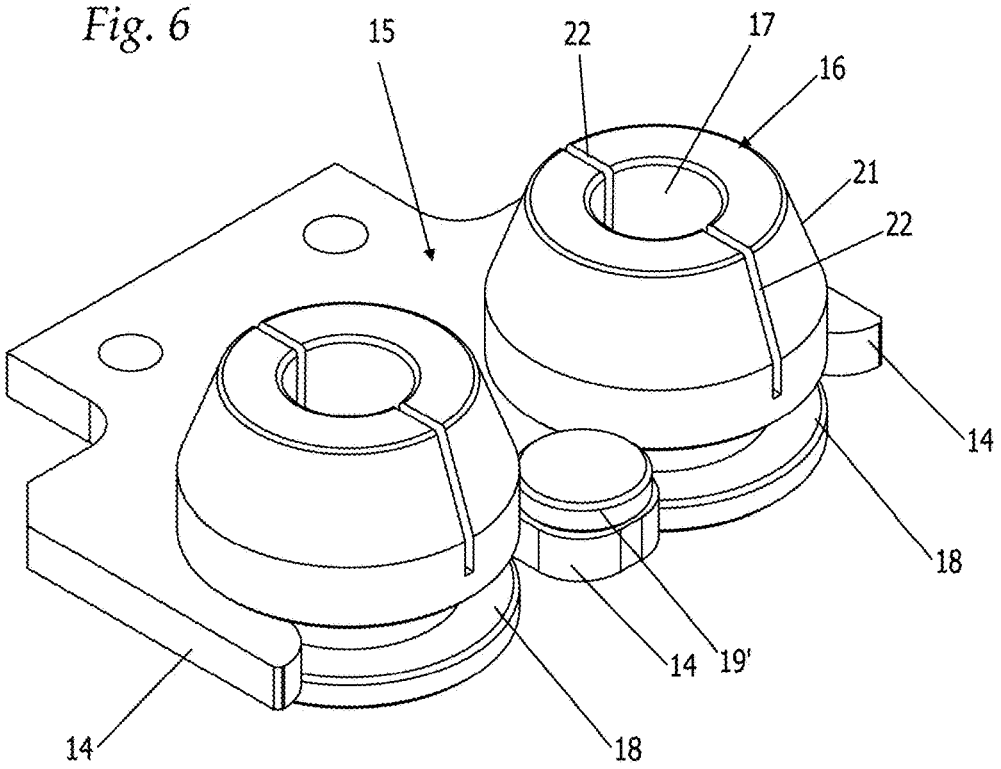
Figure 7:
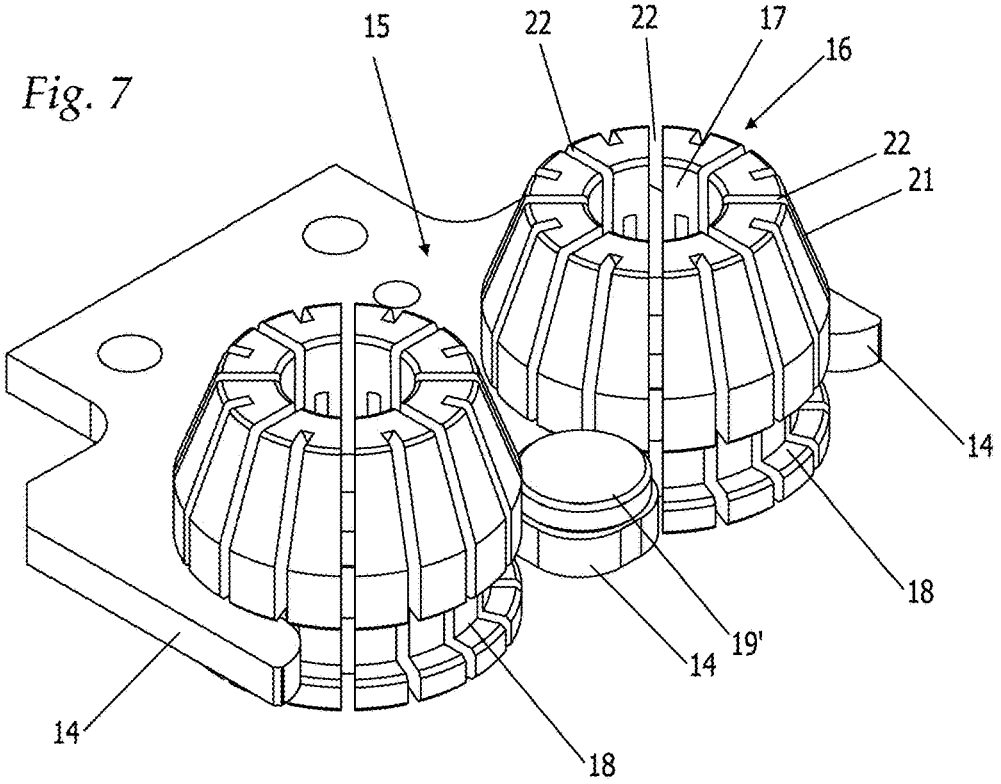
FIG. 7 shows an axonometric view of a possible variant of FIG. 6.

Each bushing 16 also comprises a conical surface 21 and at least one radial cut 22 running the entire height of the bushing 16 (FIGS. 4-6). In the variant shown in FIG. 7, on the other hand, the bushings 16 comprise a plurality of cuts 22 arranged in a star-like pattern.

Since said loading machine 1 must also be highly efficient in terms of preparation speed, every time there is a change in the caliber of the cases 2 to be loaded, the support bushings 16 for the cases 2 need to be easily replaceable.

To that end, said conveyor guide 11 comprises means for reversibly retaining said bushings 16 in said seats 12, to allow them to be removed and replaced as a function of the caliber c of the cases 2 to be loaded.

In particular, said retaining means comprise pins 19 the head of which 19' partially engages the free space comprised between the arms 14 of each U-shaped seat 12, defined by distance D.

In the variant shown in FIGS. 4-7, where each fork 15 defines two seats 12, a single pin 19 arranged on the arm 14 common to the two seats 12, acts as a retaining means for both bushings 16. On the end of this arm 14, in fact, a hole 20 is provided, adapted to be engaged by the shank 19" of this pin 19, leaving the head 19' projecting above the arm 14, so as to act as a striker and stop for both bushings 16.

Advantageously, said pin 19 is made of a ferro-magnetic material; its shank 19" is smooth and remains in position in the hole 20 by means of simple shape coupling, without the need for any threading; using a magnet it is therefore possible to extract the pin 19 from the hole 20 quickly and without difficulty.

Once the pin 19 has been removed, and the seats 12 freed from the retaining means, the bushings 16 can be removed and replaced with other bushings 16 having a central hole 17 of the right diameter φ.

Figure 8:
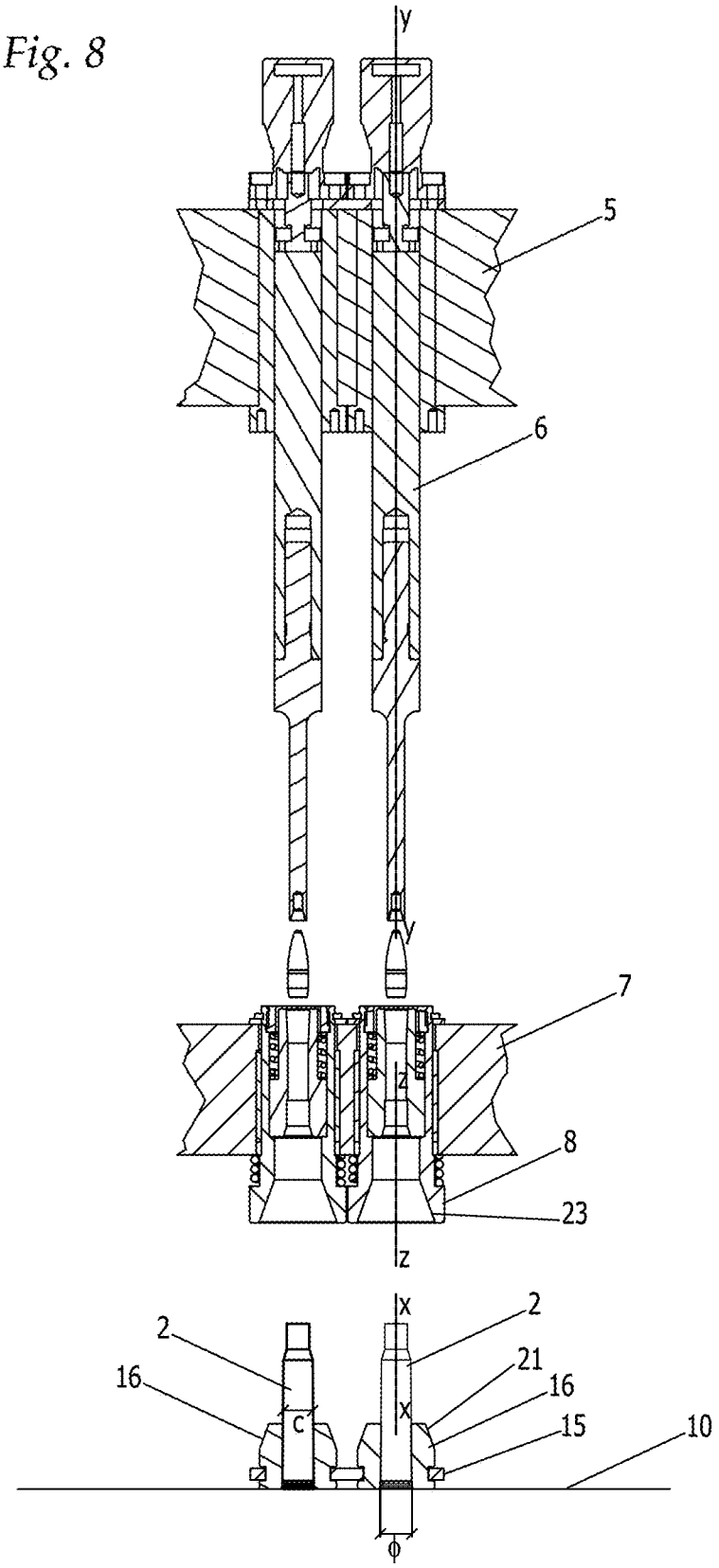
FIGS. 8-10 show, transversal cross-section along a horizontal plane, a work station of the loading machine, with certain components not shown for the purpose of clarity, in three different working stages.
Figure 9:
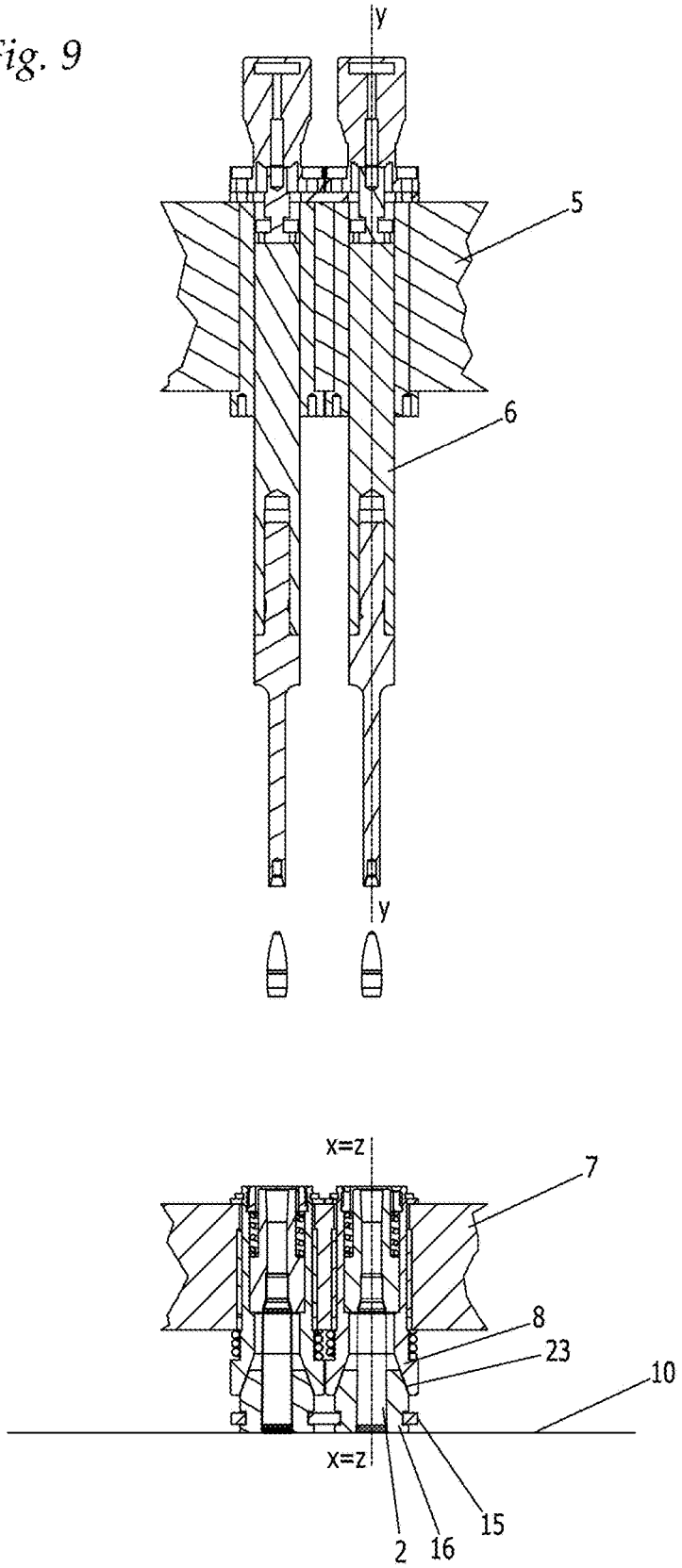
Figure 10:
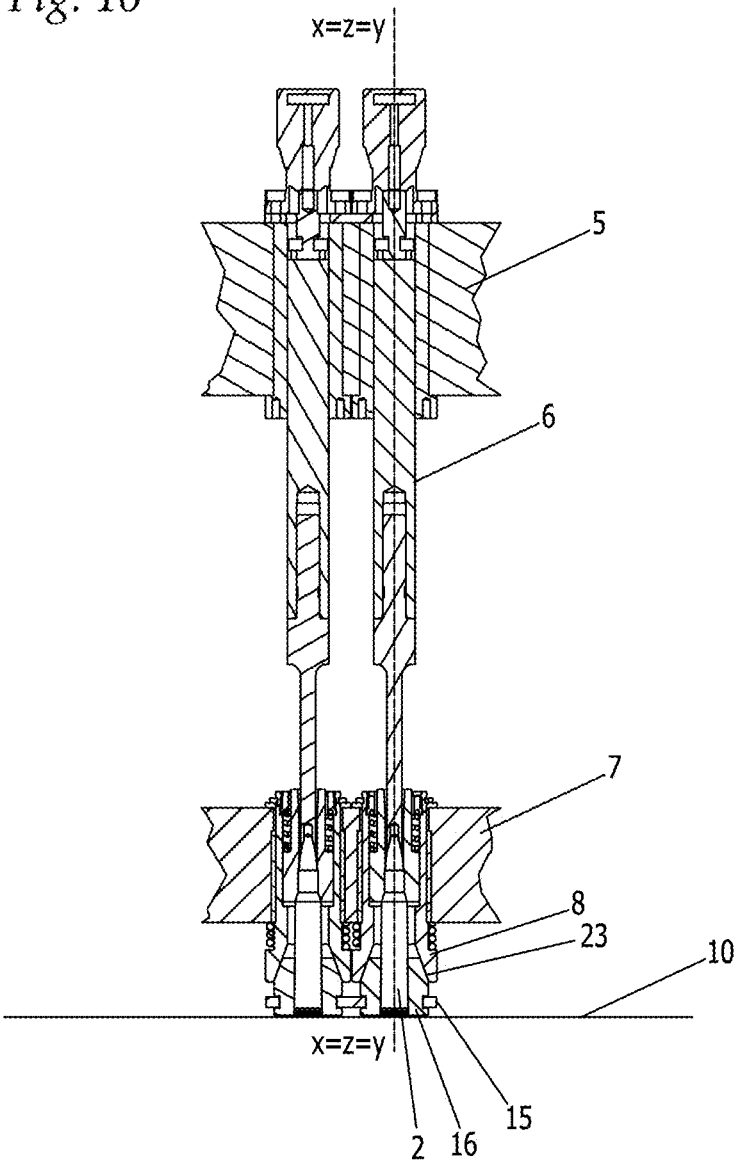

With reference to the cross-sections shown in FIGS. 8-10, the particular geometry of the centering cylinders 8 is shown, and how they cooperate with the bushings 16.

Each hollow centering cylinder 8 is provided with a conical surface 23 on the inside, having a flaring form complementary with the conical surface 21 of said bushings 16.

In the non-conical portion of the cylinder 8, its internal diameter is such as to allow the precise movement inside it of the corresponding working tool 6 with which it is coupled.

The cross-sections shown in FIGS. 8-10 are also useful for understanding the operation of the loading machine 1 as a whole.

FIG. 8 shows a bushing 16 with the respective case 2 inserted, housed in a corresponding seat 12 with a certain freedom of movement given by the difference between the outer diameter of the bushing d, measured at its annular groove 18, and the internal dimension D of the seat 12.

Above the case 2 a centering cylinder 8 is provided, supported by said second operating beam 7, coaxial to a working tool 6, provided even further above and supported by said first operating beam 5.

Said centering cylinder 8 and said working tool 6 have their respective vertical axes y, z coinciding, while it is not yet strictly necessary for axis x of the case 2 underneath to do so.

FIG. 9 shows the delicate phase of centering the case 2.

Said second operating beam 7, controlled by the control unit and moved by the corresponding motor means, is vertically lowered until the centering cylinder 8 touches the bushing 16 underneath.

At this point, said second operating beam 7 pushes downwards so that the conical surface 23 of the cylinder 8 cooperates, by means of shape coupling, with the conical surface 21 of the bushing 16.

As the centering cylinder 8 descends along the body of the bushing 16, the latter is deformed and tightens, thanks to the cuts 22, around the case 2, and moves on the horizontal plane inside said seat 12 controlled by said centering cylinder 8.

The case 2, held by the bushing 16, consequently moves until coaxiality is obtained between its longitudinal axis x and the vertical axis z of said centering cylinder 8.

Once said coaxiality has been achieved, the case 2 is ready to be filled with the internal accessories and/or processed by the corresponding working tool 6 above.

As shown in FIG. 10, during the phase of loading the case 2, said first operating beam 5 is lowered and said tool 6 slides inside the hollow centering cylinder 8 until it reaches the mouth of the case 2.

Once the case 2 has been processed, said first operating beam 5 retreats, thereby freeing the centering cylinder 8 from the tool 6. The second operating beam 7 is then also raised, entirely freeing the bushing 16 and the case 2.

The conveyor guide 11 can then translate horizontally to a position along the trajectory of the race 10, positioning the bushing 16 and the processed case 2 below another adjacent work station.

Thanks to the automatic system for centering the cases 2 under the working tools 6 according to the invention, all operations to prepare the loading machine 1 require very little time, in the region of a few minutes, with no need for verification and alignment instruments, thereby considerably speeding up and simplifying operations that would take several hours using traditional technologies, and would also require the use of qualified personnel and specific instrumentation.

The invention claimed is:

1. A loading machine (1) for cartridges with a metal case (2) comprising:

a frame structure (3) with a feeder provided thereon, the feeder configured for feeding a plurality of cases (2) having a given caliber (c) and a longitudinally extending axis (x);

a first operating beam (5), mounted on said frame structure (3), having an alternating vertical translation movement and provided with working tools (6) each extending along a vertical axis (y), adapted to load said cases (2); and a control unit (24) in operative communication with the frame structure (3) and adapted to control a functioning of the loading machine;

wherein said feeder includes:

a race (10) adapted to support and to allow feed of said cases (2) in a given direction, and a conveyor guide (11), arranged parallel to said race (10) and comb shaped to define a plurality of seats (12)adapted to contain said cases (2), the conveyor guide (11) configured to convey said cases (2) along said race (10), and to position said cases (2) under the working tools (6), wherein said conveyor guide (11) includes a plurality of bushings (16), each bushing (16) having at least a first conical surface (21) and a hole (17) adapted to house one of said cases (2) and being housed in one of said seats (12), an outer diameter (D) of said bushing (16) being less than an inner dimension (d) of said seats (12) to provide a minimum freedom of movement between the bushing (16) and a corresponding seat (12), wherein said machine (1) further comprises a second operating beam (7) mounted on said frame structure (3), having an alternating vertical translation movement that is coordinated with the alternating vertical translation movement of said first operating beam (5), said second operating beam (7) provided with a plurality of hollow centering cylinders (8) each having a vertical axis (z) and a second conical surface (23) therein, each centering cylinder (8) being arranged so that the vertical axis (z) thereof coincides with the vertical axis (y) of a corresponding one of said tools (6), and wherein coupling between the first conical surface (21) of each bushing (16) and the second conical surface (23) of a corresponding centering cylinder (8) causes shifting of said bushing (16) in said seat (12), and consequently shifting of the case (2) housed in said bushing (16), to obtain coaxiality between the longitudinal axis (x) of said case (2) and the vertical axis (z) of said centering cylinder (8).

2. The loading machine (1) according to claim 1, wherein each of said bushings (16) has at least one radial cut (22) adapted to allow an elastic deformation of the bushing during insertion of the case (2) into the hole (17).

3. The loading machine (1) according to claim 1, wherein said conveyor guide (11) comprises means for reversibly retaining said bushings (16) in said seats (12), to allow said bushings to be removed and replaced as a function of the caliber (c) of the cases (2) to be loaded.

4. The loading machine (1) according to claim 3, wherein each seat (12) is U-shaped, and wherein said retaining means comprise pins (19), the head (19') of which at least partially engages a space between the arms (14) of each U-shaped seat (12).

5. The loading machine (1) according to claim 4, wherein said bushing (16) comprises an annular groove (18) obtained on an outer surface of said bushing, and wherein the arms (14) of said U-shaped seat (12) are adapted to engage said groove (18) to sustain said bushing (16).

6. The loading machine (1) according to claim 1, wherein said frame structure (3) comprises vertical guides (9) engaged by both said first (5) operating beam and said second (7) operating beam, so that planes to which said beams respectively belong remain parallel to each other during respective vertical translation movements of said first and second operating beams.

* * * * *